US007501960B2

(12) United States Patent
Price et al.

(10) Patent No.: US 7,501,960 B2
(45) Date of Patent: Mar. 10, 2009

(54) CONTROL OF INDICATOR LIGHTS IN PORTABLE INFORMATION HANDLING SYSTEM USING AMBIENT LIGHT SENSORS

(75) Inventors: Erin L. Price, Pflugerville, TX (US); John J. Breen, Harker Heights, TX (US); Andrew T Sultenfuss, Leander, TX (US)

(73) Assignee: Dell Products L.P., Round Rock, TX (US)

( * ) Notice: Subject to any disclaimer, the term of this patent is extended or adjusted under 35 U.S.C. 154(b) by 328 days.

(21) Appl. No.: 11/254,341

(22) Filed: Oct. 20, 2005

(65) Prior Publication Data

US 2007/0090962 A1 Apr. 26, 2007

(51) Int. Cl.
*G08B 3/00* (2006.01)

(52) U.S. Cl. ..... 340/691.6; 340/691.8; 345/102

(58) Field of Classification Search ..... 340/691.1, 340/691.6, 691.8, 7.55, 691.4; 345/63, 102, 345/170, 204, 207, 169; 235/462.01, 472.01
See application file for complete search history.

(56) References Cited

U.S. PATENT DOCUMENTS

| | | | | |
|---|---|---|---|---|
| 5,239,295 | A * | 8/1993 | DeLuca et al. | 340/7.4 |
| 6,947,017 | B1 * | 9/2005 | Gettemy | 345/63 |
| 6,976,626 | B2 * | 12/2005 | Schmidt et al. | 235/462.01 |
| 7,012,380 | B2 | 3/2006 | Price et al. | 315/209 |
| 7,016,208 | B2 | 3/2006 | Price et al. | 363/132 |
| 7,236,154 | B1 * | 6/2007 | Kerr et al. | 345/102 |
| 7,268,775 | B1 * | 9/2007 | Gettemy | 345/204 |
| 2005/0180183 | A1 | 8/2005 | Price et al. | 363/132 |
| 2005/0285546 | A1 | 12/2005 | Price et al. | 315/291 |
| 2006/0018132 | A1 | 1/2006 | Price et al. | 363/17 |
| 2006/0256067 | A1 * | 11/2006 | Montero et al. | 345/102 |

OTHER PUBLICATIONS

B. Ferguson, "Optical Design of Ambient Light Sensor," Microsemi Integrated Products, 2004, pp. 1-6 http://www.microsemi.com/micnotes/1404.pdf.

B. Ferguson, "LX1970 Visible Light Sensor," Microsemi Integrated Products, 2004, pp. 1-11 http://www.microsemi.com/micnotes/1403.pdf.

"Apple—PowerBook G4—Technical Specifications," http://www.apple.com/pwerbook/specs.html, printed Mar. 20, 2006, pp. 1-3.

"Product Details," ACER, http://www.acer.com.hk/english/product/tmc200-f.html, printed Mar. 29, 2006, pp. 1-2.

* cited by examiner

*Primary Examiner*—Van T. Trieu
(74) *Attorney, Agent, or Firm*—Hamilton & Terrile, LLP; Gary W. Hamilton

(57) ABSTRACT

An improved system and method for controlling the brightness of indicator lights used on portable information handling systems. Various embodiments of the invention optimize the output of the indicator lights in accordance with detected ambient light levels. The brightness of the indicator lights can be adjusted automatically in accordance with a fixed response curve or manually by user inputs. In some embodiments, the brightness is adjusted in accordance with user-designated preferences that are stored in a brightness preference table and correlated with detected ambient light levels.

18 Claims, 3 Drawing Sheets

CONTROL OF INDICATOR LIGHTS IN PORTABLE INFORMATION HANDLING SYSTEM USING AMBIENT LIGHT SENSORS

BACKGROUND OF THE INVENTION

1. Field of the Invention

The present invention relates in general to the field of information handling system displays, and more particularly to a system and method for controlling indicator lights in portable information handling systems.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems configured as portable units have grown in popularity among users over the past several years. Portable information handling systems generally integrate in a single housing a display, internal power source and processing components, such as the CPU and hard disk drive, so that a user can carry the portable system from place to place while the system is operating. As processing components have decreased in size and increased in performance, portable information handling systems are often able to pack processing capabilities into a relatively small housing that are comparable to the capabilities available from desktop systems. One important consideration to achieving portability is reducing the power consumption of the components within the system so that the internal power will support operations for a long enough time period. Generally, the most practical display solution for portable systems both in terms of size and power consumption are liquid crystal display (LCD) panels. LCD panels have a backlight, such as cool cathode florescent light (CCFL) that illuminates the display through a panel of pixels. An image is generated by altering the light-absorbing characteristics of the pixels so that backlight passing through a pixel has a desired color.

In addition to the CCFL, most portable information handling systems comprise a plurality of indicator lights that consume battery power. For example, some portable information handling systems have up to 48 configurable LED indictor lights. Each LED consumes up to 100 mW of power at maximum brightness, resulting in a possible power consumption of 4.8 W when all LEDs are active. This level of power consumption can result in a significant drain on the battery. Furthermore, a large number of active indicator lights can be distracting in a dim environment.

In view of the foregoing, there is a need for a system and method to control the brightness and power consumption of indicator lights on portable information handling systems both to optimize power consumption and to enhance the aesthetic appearance of the indicator lights.

SUMMARY OF THE INVENTION

The present invention provides an improved system and method for controlling the brightness of indicator lights used on portable information handling systems.

Various embodiments of the invention optimize the output of the indicator lights in accordance with detected ambient light levels. Control logic is operable to receive signals from an ambient light sensor and to generate appropriate control signals to modify the output of the indicator lights. The brightness of the indicator lights can be adjusted automatically in accordance with a fixed response curve. In some embodiments of the invention, the brightness of the indicator lights is adjusted in accordance with manual user inputs, thereby changing the brightness of the indicator lights from a nominal value associated with a sensed ambient light level to a level manually selected by the user.

In some embodiments, the brightness is adjusted in accordance with user-designated preferences that are stored in a brightness preference table and correlated with detected ambient light levels. After the user preference data has been stored, subsequent use of the information handling system will result in indicator light brightness levels corresponding to the user-specified settings for predetermined ambient light levels.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Information handling system display brightness adjustments compensate for both ambient light levels and user brightness preferences at various ambient light levels to provide improved display brightness management with reduced direct user involvement. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
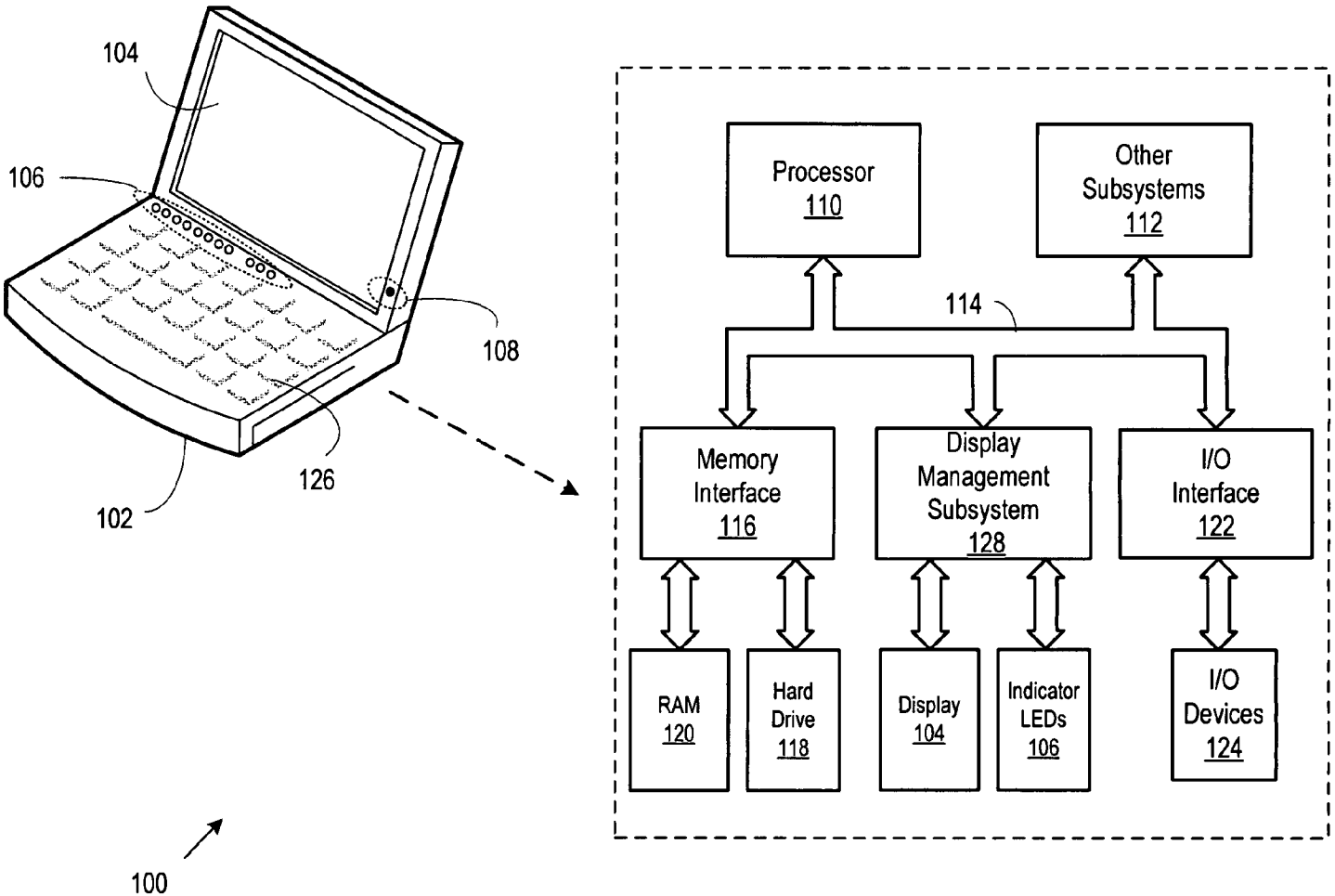
FIG. 1 is a block diagram of an information handling system having a plurality of indicator lights with ambient light brightness correction.

Referring now to FIG. 1, a block diagram depicts an information handling system 100 configured as a portable system having a plurality of processing components disposed in a housing 102. In various embodiments of the invention discussed below, the brightness of the display 104 and a plurality of indicator lights 106 are controlled by a display management system that is operable to receive inputs from an ambient light sensor 108. The functional components of the information handling system include a processor 110 and various other subsystems 112 understood by those skilled in the art. Data is transferred between the various system components via various data buses illustrated generally by bus 114. A memory interface 116 is operable to control data stored in various memory devices including a hard drive 118 and RAM 120. An input/output (I/O) interface 122 controls the transfer of data between the various system components and a plurality of input/output (I/O) devices 124, such as a keyboard 126, and various devices that may be attached to the information handling system via a plurality of I/O ports known to those of skill in the art. A display management subsystem 128, described in greater detail below, is operable to manage power consumption in the information handling system 110 by controlling the power consumption of individual components of the information handling system, such as the display 104 and the indicator lights 106.

Figure 2:
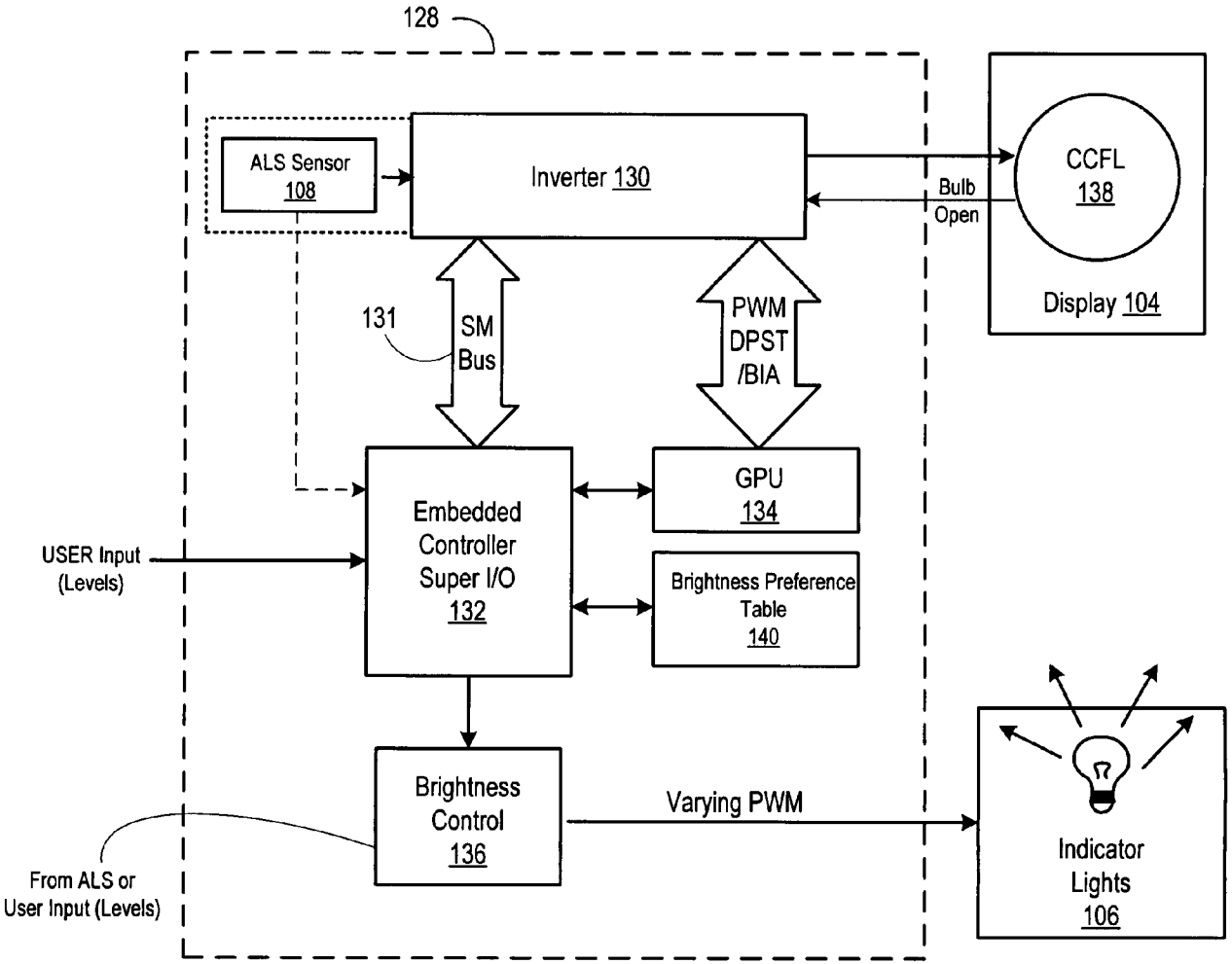
FIG. 2 is a block diagram of the functional components of a display management subsystem for controlling the output level of a plurality of indicator lights in a portable information handling system.

FIG. 2 is a block diagram illustration of functional components of the display management subsystem 128 for controlling the brightness of the display 104 and indicator lights 106. The display management subsystem is broadly comprised of an inverter 130, an embedded controller/super I/O (EC/SIO) module 132, a graphics processing unit (GPU) 134, and a brightness control module 136. The ambient light sensor 108 detects the ambient light level in the vicinity of the information handling system 100 and provides the detected ambient light level to the EC/SIO 132 via an SMBus 131. In an embodiment of the invention, the ambient light sensor 108 is integrated into the inverter 130. In other embodiments of the invention, the ambient light sensor 108 can be a separate module that provides an input signal to the EC/SIO 132.

The EC/SIO 132 has firmware that automatically adjusts the brightness output from display 104 to compensate for the detected ambient light level. The EC/SIO 132 manages the brightness of the display 104 by controlling the power output of the inverter 130 that is capable of providing incrementally variable power levels to a CCFL 138 in the display 104.

In addition to automated adjustments in response to detected ambient light, EC/SIO 132 is operable to accept manual user brightness selections and performs automated user brightness preference adjustments. The GPU 134 is operable to provide DPST backlight image adaptation (BIA) adjustments to the inverter to ensure that the adjustments are not perceptible by a user.

Manual brightness adjustments are made by the user through keyboard 126 to cause the EC/SIO 132 to generate appropriate commands to increase or decrease the brightness of the display 104. For instance, each selection of control key and an up arrow on keyboard 126 can be interpreted by EC/SIO as a command to incrementally increase display brightness above the brightness level set in response to the detected ambient light level. Firmware embedded in the EC/SIO 132 analyzes the manual user adjustments to establish a user brightness preference for the detected ambient light level. The user brightness preference automatically establishes the user's manually input brightness level for the display brightness if a similar level of ambient light is detected in a subsequent use of display 104.

The display management system 128 is also operable to control the indicator lights 106 by using many of the functional components discussed above regarding the control of the display 104. The EC/SIO 132 manages the brightness of the indicator lights 106 by generating appropriate control signals for use by brightness control module 136. As discussed above, the ambient light sensor 108 detects the ambient light level and provides the detected ambient light level to EC/SIO 132 via the SMBus 131. The EC/SIO 132 has firmware that automatically adjusts the brightness of the display lights 106 to compensate for the detected ambient light level. The EC/SIO 132 is also operable to accept manual user brightness selections and performs automated user brightness preference adjustments to control the output of the indicator lights 106.

As is the case for controlling the display 104, manual brightness adjustments can be made by the user through keyboard 126 to cause the EC/SIO 132 to generate appropriate commands to increase or decrease the brightness of the indicator lights 106. The firmware embedded in the EC/SIO 132 analyzes the manual user inputs to establish a user brightness preference for the detected ambient light level. The EC/SIO 132 also uses the user inputs to automatically establish brightness levels for the indicator lights 106 if a similar level of ambient light is detected in a subsequent user session of the information handling system 100.

The EC/SIO 132 is also operable to analyze a user's brightness preferences for the display 104 and the indicator lights 106 and to store those preferences in a user brightness preference table 140. The user preferences stored in the brightness preference table 140 can be used by the firmware in the EC/SIO 132 to fine-tune the brightness output of the indicator lights 106 for various levels of detected ambient light. When the information handling system 100 is powered on and an ambient light level is detected, the EC/SIO 132 is operable to use the data stored in the brightness preference table 140 to generate control signals that are used by the brightness control module 136 to cause the indicator lights 106 to generate light at a predetermined brightness level associated with the detected ambient light level. In various embodiments of the invention, the brightness control module 136 uses varying pulse width modulation (PWM) signals to control the brightness of the indicator lights 106.

Manual brightness adjustments entered by a user are used by the EC/SIO 132 to generate control signals to change the brightness level, with each incremental manual input having a corresponding incremental change in brightness. The EC/SIO 132 determines the difference between the predetermined brightness for the detected ambient light level and the user's manually selected brightness preference and stores that value in user brightness preference table 140. When, in a subsequent use of the system, the same ambient light level is detected, the EC/SIO 132 automatically generates control signals that are used by the brightness control module to compensate for the user preference that was previously manually selected at that ambient light level. In one embodiment, EC/SIO 132 analyzes user brightness preferences by storing user preferences manually input by a user for a plurality of predetermined ambient light levels. In an alternative embodiment, the EC/SIO 132 predicts user brightness preferences by applying a model to historical manual brightness adjustments made by a user. In yet another embodiment, the EC/SIO 132 allows direct access by a user to user brightness preference table 38 so that the user may directly input the user's brightness preferences at various detected ambient light levels.

Figure 3:
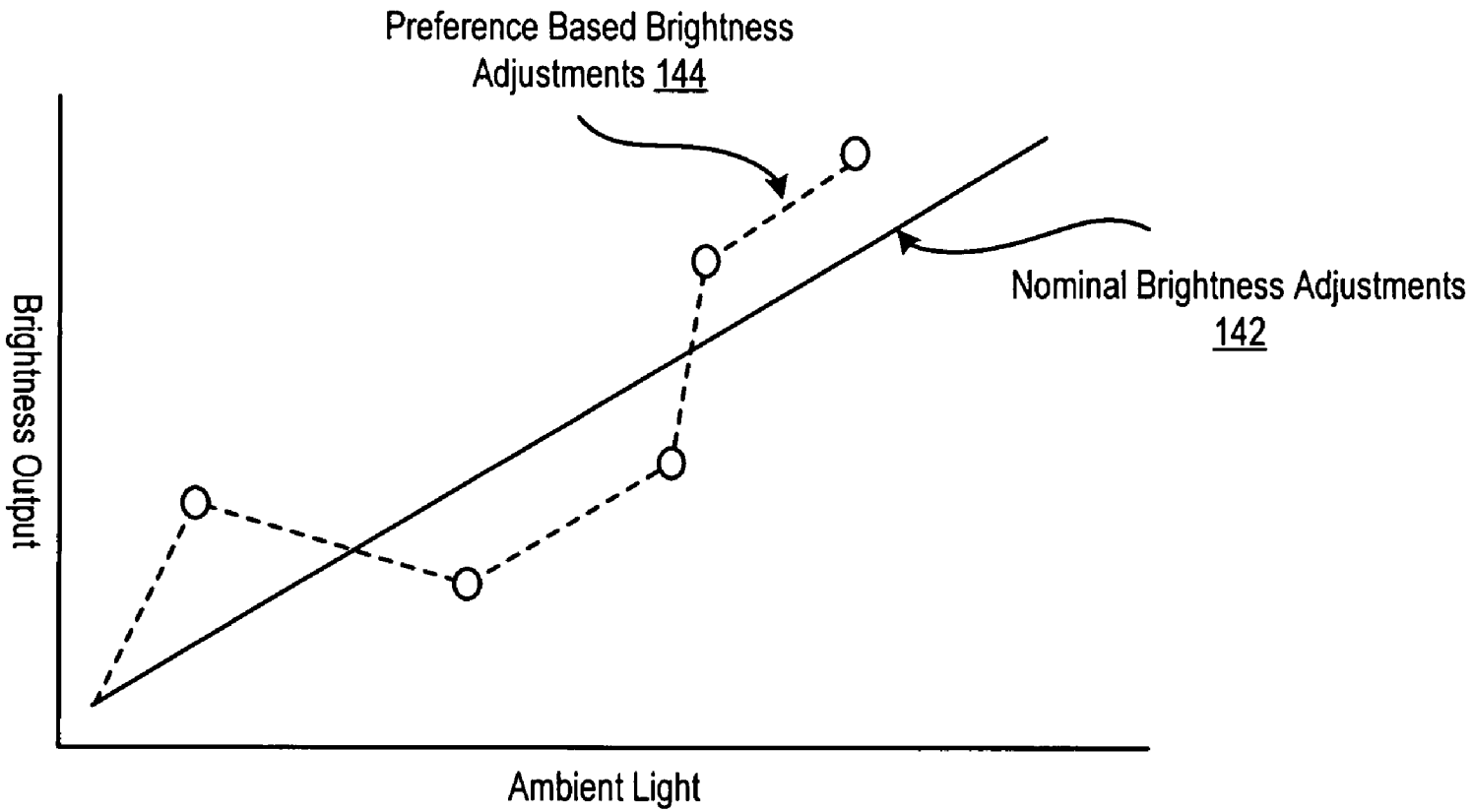
FIG. 3 is a graphical illustration modification of the brightness of indicator lights in an information handling system using ambient light correction with and without user brightness preference adjustments.

FIG. 3 is a graphical illustration of nominal brightness adjustments 142 which have a substantially linear relationship to detected ambient light. Preference based brightness adjustments 144 have a non-linear relationship relative to the detected ambient light with the user preferences for various levels of ambient light changing the brightness output compared with the nominal ambient light brightness adjustment.

Although the present invention has been described in detail, it should be understood that various changes, substitutions and alterations can be made hereto without departing from the spirit and scope of the invention as defined by the appended claims.

What is claimed is:

1. An information handling system comprising: plural data processing components operable to generate visual information;

a display operable to present the visual information;

a plurality of indicator lights;

a light sensor operable to detect ambient light to generate a data signal in response thereto; wherein said display is controlled by an inverter and said light sensor is integrated with said inverter;

a controller operable to receive said data signal from said light sensor corresponding to ambient light levels and to generate control signals therefrom; and a brightness control module interfaced with the controller, the brightness control module operable to use said control signal to set the brightness of said indicator lights.

2. The information handling system of claim 1, wherein said control signal is generated in accordance with a fixed response curve.

3. The information handling system of claim 1, wherein said control signal is generated in accordance with user-defined settings corresponding to brightness of said indicator lights.

4. The information handling system of claim 3, wherein said user-defined settings are stored in a brightness preference table.

5. The information handling system of claim 4, wherein said user-defined settings are used to generate a historical model of user preferences for brightness levels of said indicator lights.

6. The information handling system of claim 5, wherein said historical model is used to predict user preferences for brightness of said indicator lights.

7. A method for controlling brightness of indicator lights on an information handling system, comprising:

using a light sensor to detect ambient light to generate a data signal in response thereto, wherein said light sensor is integrated into an inverter operable to control a display operably coupled to said information handling system;

using a controller to receive said data signal from said light sensor corresponding to ambient light levels and to generate a control signal therefrom; and receiving said control signal in a brightness control module operable to use said control signal to set the brightness of said indicator lights.

8. The method of claim 7, wherein said control signal is generated in accordance with a fixed response curve.

9. The method of claim 8, wherein said control signal is generated in accordance with user-defined settings corresponding to brightness of said indicator lights.

10. The method of claim 9, wherein said user-defined settings are stored in a brightness preference table.

11. The method of claim 10, wherein said user-defined settings are used to generate a historical model of user preferences for brightness levels of said indicator lights.

12. The method of claim 10, wherein said historical model is used to predict user preferences for brightness of said indicator lights.

13. A system for controlling brightness levels of indicator lights in an information handling system, comprising:

a plurality of indicator lights;

a light sensor operable to detect ambient light to generate a data signal in response thereto, wherein said light sensor is integrated into an inverter operable to control a display operably coupled to said information handling system;

a controller operable to receive said data signal from said light sensor corresponding to ambient light levels and to generate control signals therefrom; and a brightness control module interfaced with the controller, the brightness control module operable to use said control signal to set the brightness of said indicator lights.

14. The system of claim 13, wherein said control signal is generated in accordance with a fixed response curve.

15. The system of claim 13, wherein said control signal is generated in accordance with user-defined settings corresponding to brightness of said indicator lights.

16. The system of claim 15, wherein said user-defined settings are stored in a brightness preference table.

17. The system of claim 16, wherein said user-defined settings are used to generate a historical model of user preferences for brightness levels of said indicator lights.

18. The system of claim 17, wherein said historical model is used to predict user preferences for brightness of said indicator lights.

* * * * *